United States Patent [19]

Skinner

[11] Patent Number: 4,513,916

[45] Date of Patent: Apr. 30, 1985

[54] FUEL INJECTION NOZZLE

[75] Inventor: Robert T. J. Skinner, High Wycombe, England

[73] Assignee: Lucas Industries, Birmingham, England

[21] Appl. No.: 534,283

[22] Filed: Sep. 21, 1983

[30] Foreign Application Priority Data

Oct. 14, 1982 [GB] United Kingdom ..... 8229329

[51] Int. Cl.[3] ..... F02M 61/08

[52] U.S. Cl. ..... 239/453; 239/533.9

[58] Field of Search ..... 239/453, 456, 459, 533.9, 239/533.12

[56] References Cited

U.S. PATENT DOCUMENTS 4,410,141 10/1983 Seifert ..... 239/453
4,417,693 11/1983 Füssner ..... 239/533.9
4,442,978 4/1984 Seifert ..... 239/453

*Primary Examiner*—Andres Kashnikow
*Assistant Examiner*—Scott D. Malpede

[57] ABSTRACT

A fuel injection nozzle for supplying fuel to an internal combustion engine is of the outwardly opening type and includes a valve member which is biased by a first spring to the closed position, a second spring is provided and is arranged so that it initially opposes the first spring and finally assists the first spring there being a range of movement of the valve member against the action of the first spring only.

2 Claims, 3 Drawing Figures

FUEL INJECTION NOZZLE

This invention relates to a fuel injection nozzle for supplying fuel to an internal combustion engine, the nozzle being of the so-called outwardly opening type and comprising a valve assembly which is housed within a chamber to which in use, fuel is supplied under pressure, the valve assembly including a valve body defining a bore, a seating defined at or adjacent one end of the bore, the portion of the bore downstream of the seating defining an outlet opening, a valve member slidable in said bore, the valve member having a head located in said outlet opening, the head being shaped for co-operation with the seating, and resilient means acting between the valve member and the valve body, said resilient means acting to urge the head of the valve member into contact with the seating, said head in use being lifted from the seating by fuel under pressure in the chamber to allow fuel flow through said outlet opening.

The object of the invention is to provide a fuel injection nozzle of the aforesaid kind in a simple and convenient form.

According to the invention a fuel injection nozzle for supplying fuel to an internal combustion engine, the nozzle being of the so-called outwardly opening type and comprises a valve assembly housed within a chamber, a fuel inlet to said chamber, the valve assembly including a valve body defining a bore, a seating defined adjacent one end of the bore, the portion of the bore downstream of the seating defining an outlet opening, a valve member slidable in said bore, the valve member having a head located in said outlet opening and being shaped to co-operate with said seating, a retaining member mounted on the stem of the valve member remote from the seating, a sleeve member mounted about the portion of the stem which extends from the bore, said sleeve member engaging said retaining member, a flange on the sleeve member, a first coiled compression spring acting between said flange and a surface on said body, said first spring acting to bias the head of the valve member into contact with the seating, a pair of annular spring abutments located about said sleeve member intermediate said retaining member and the flange, a second coiled compression spring positioned between the abutments, means defining a step in said chamber to limit the movement of the one spring abutment which is nearer to the valve head, the other spring abutment initially engaging a further step in the chamber, but being engaged by said retaining member during movement of the valve member, said one spring abutment initially engaging a step defined in the sleeve member, the axial distance in the closed position of the valve member, between the first mentioned step in the chamber and the one spring abutment being less than the axial distance between the other spring abutment and the retaining member whereby initially the second spring opposes the action of the first spring until the one abutment engages the first mentioned step whereafter the first spring alone acts on the valve member until the other spring abutment is engaged by the retaining member.

The accompanying drawings show three forms of fuel injection nozzle and wherever possible, identical reference numerals are used throughout the drawings.

Figure 1:
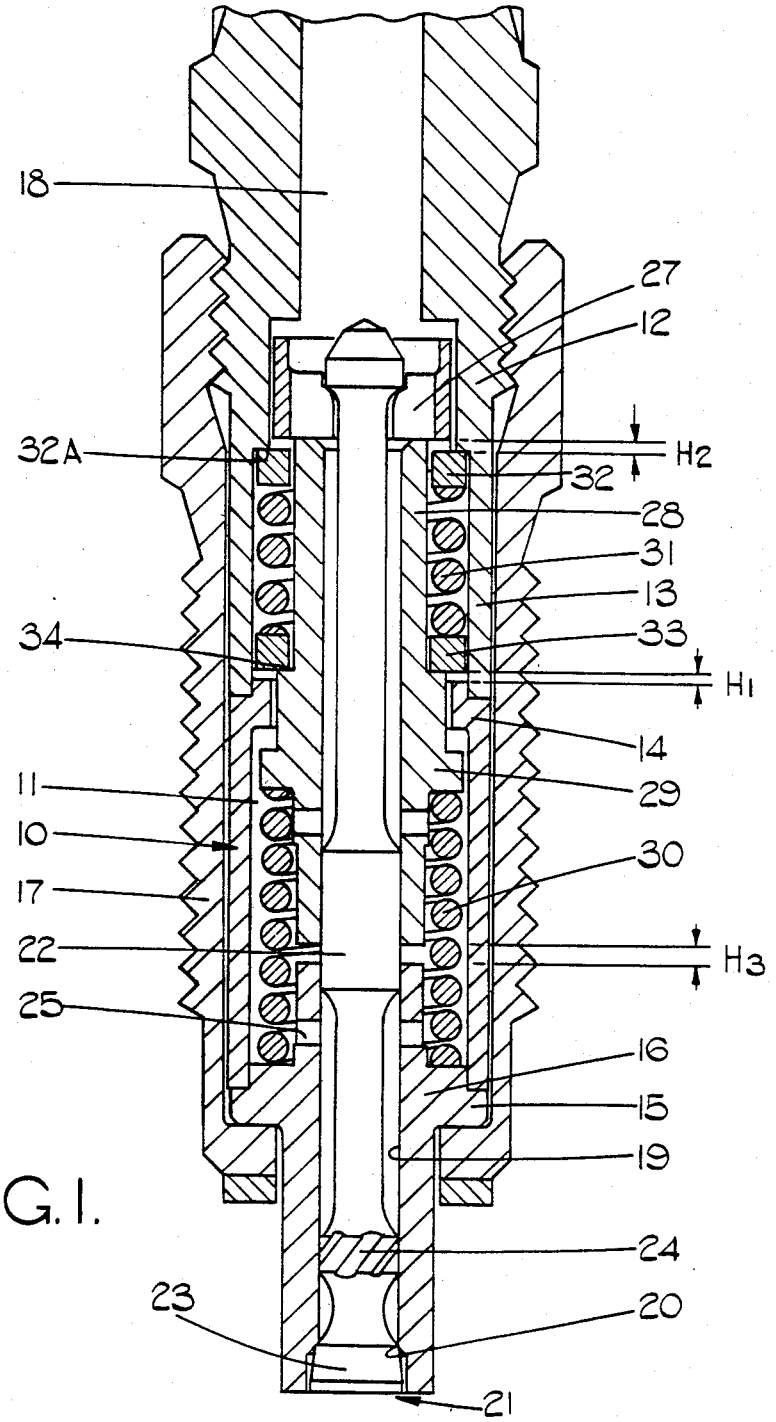
FIG. 1 shows a cross sectional view of the fuel injection nozzle in its first embodiment.

With reference to the FIG. 1 of the drawings the injection nozzle comprises a valve assembly which is generally indicated at 10, and which is housed within a chamber 11. The chamber is defined in the example of FIG. 1, by a hollow housing part 12 which defines a sleeve 13 against which is located a tubular member 14 the latter being held in engagement with a flange portion 15 of a valve body 16 forming part of the valve assembly. The valve body, the tubular member 14 and the sleeve 13 are held in assembled relationship by means of a cap nut 17 which engages the flange 15 and is in screw thread engagement with the housing part 12.

The chamber 11 is in communication with a fuel inlet passage 18 which in use, is connected to the outlet of a high pressure fuel pump. The valve body 16 in use, has at least its end face, disposed within a combustion chamber of an associated engine.

Formed in the body 16 is a bore 19 adjacent the end of which remote from the flange, is formed a seating 20. The portion of the bore downstream of the seating is of slightly enlarged diameter to define an outlet opening 21. Slidable within the bore 19 is a valve member 22 having a head 23 shaped to co-operate with the seating. The valve member is provided with a fluted portion 24 which co-operates with the wall of the bore but which allows fuel to flow therepast from an annular space defined between the wall of the bore and a reduced portion of the valve member. This space communicates with the chamber by way of openings 25.

The valve member extends from the bore and at its end remote from the valve head, defines an enlarged portion 26 with which is engaged a retaining member 27. The retaining member is in engagement with the end of a sleeve member 28 which extends towards the valve body 16 but which in the closed position of the valve member as shown in the drawing, defines a clearance therewith, this clearance being referenced in the drawing $H_3$.

The sleeve member defines a flange 29 against which engages one end of a coiled compression spring 30, the other end of which is engaged with the valve body 16. The spring 30 serves to bias the valve member into contact with the seating.

In operation, when fuel under pressure is supplied to the chamber the valve member will be moved by the pressure of fuel in the chamber, to lift the head from the seating, such movement taking place against the action of the spring 30. When the head is lifted from the seating, fuel flow can occur from the chamber through the outlet opening.

The nozzle so far described is well known in the art but in order to provide intermediate openings, an additional spring referenced 31 is incorporated into the construction as will be explained. The spring 31 is a coiled compression spring and it is located between first and second abutments 32, 33. The abutments are of annular form and are located about the sleeve member 28. In the closed position of the valve member as shown, the abutment 32 engages a step 32A defined on the housing part 12 while the abutment 33, is located against a stop surface 34 forming part of the sleeve member 28. The valve retainer member 27 is spaced from the abutment 32 by a distance indicated in the drawing as $H_2$ and furthermore, the ring 33 is spaced from the adjacent end of the tubular member 14 by a distance indicated in the drawing as $H_1$.

The spring 30 must exert a greater force than the spring 31. In operation, when fuel under pressure is supplied to the chamber, the initial movement of the valve member under the action of fuel pressure, takes place against the action of the spring 30 but assisted by the action of the spring 31 until the clearance $H_1$ between the abutment 33 and the tubular member 14 is taken up. The clearance $H_2$ between the abutment 32 and the retainer member 27 is greater than the clearance $H_1$ so that as the pressure in the chamber continues to increase, the valve member will move away from its seating against the action of the spring 30 only and this movement continues until the clearance $H_2$ has been taken up. At this stage both springs come into operation to oppose the movement of the valve member. The movement of the valve member away from its seating is halted when the clearance $H_3$ between the valve body 16 and the sleeve member 28 has been taken up. The nozzle therefore has three stages of movement, the spring 31 initially assisting the movement of the valve member and finally opposing the movement of the valve member there being an intermediate stage in which the spring plays no part in controlling the movement of the valve member.

Figure 2:
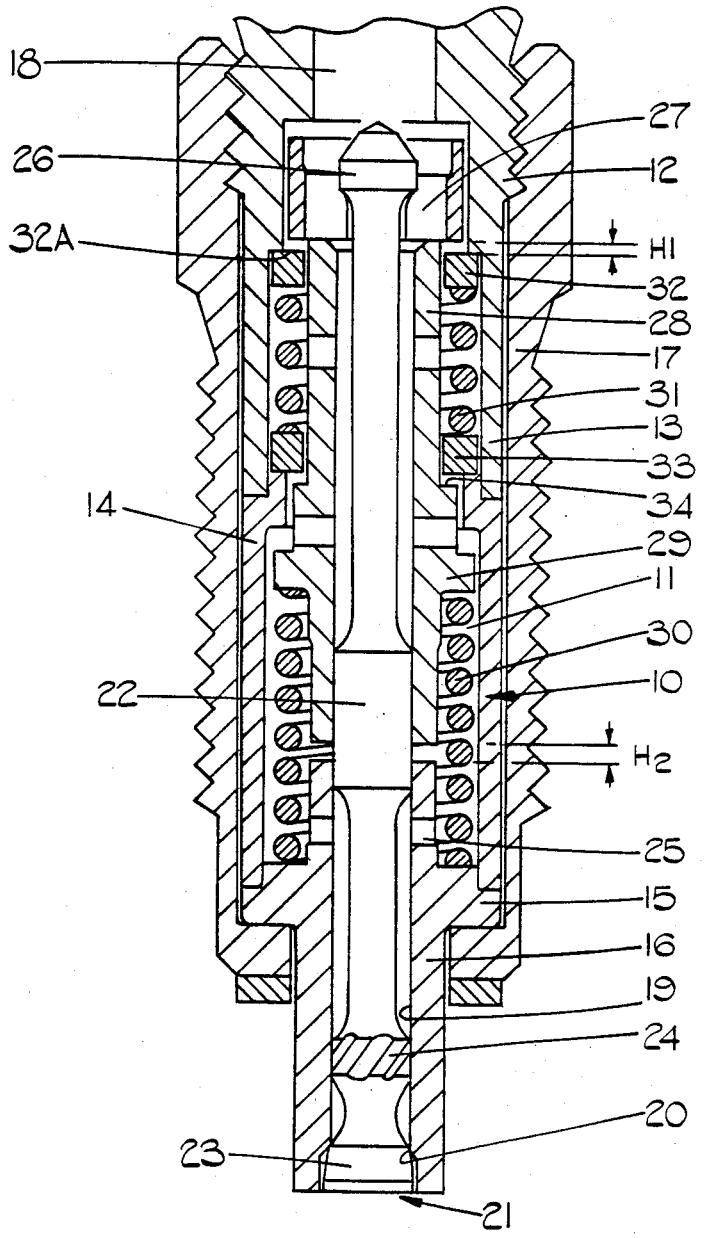
FIG. 2 shows a cross sectional view of the fuel injection nozzle in its second embodiment.

The construction of nozzle can be very readily modified to provide different operating characteristics. In the arrangement of FIG. 2 the abutment 32 in the closed position of the valve member engages the step 32A and the abutment 33 engages the end of the tubular member 14. The spring 31 is therefore in a prestressed state. In operation therefore the initial movement of the valve member takes place against the action of the spring 30 only until the clearance $H_1$ between the retainer member 27 and the abutment 32 is taken up. Thereafter the spring 31 opposes the movement of the valve member in conjunction with the spring 30, the total movement of the valve member being represented by the distances $H_2$.

Figure 3:
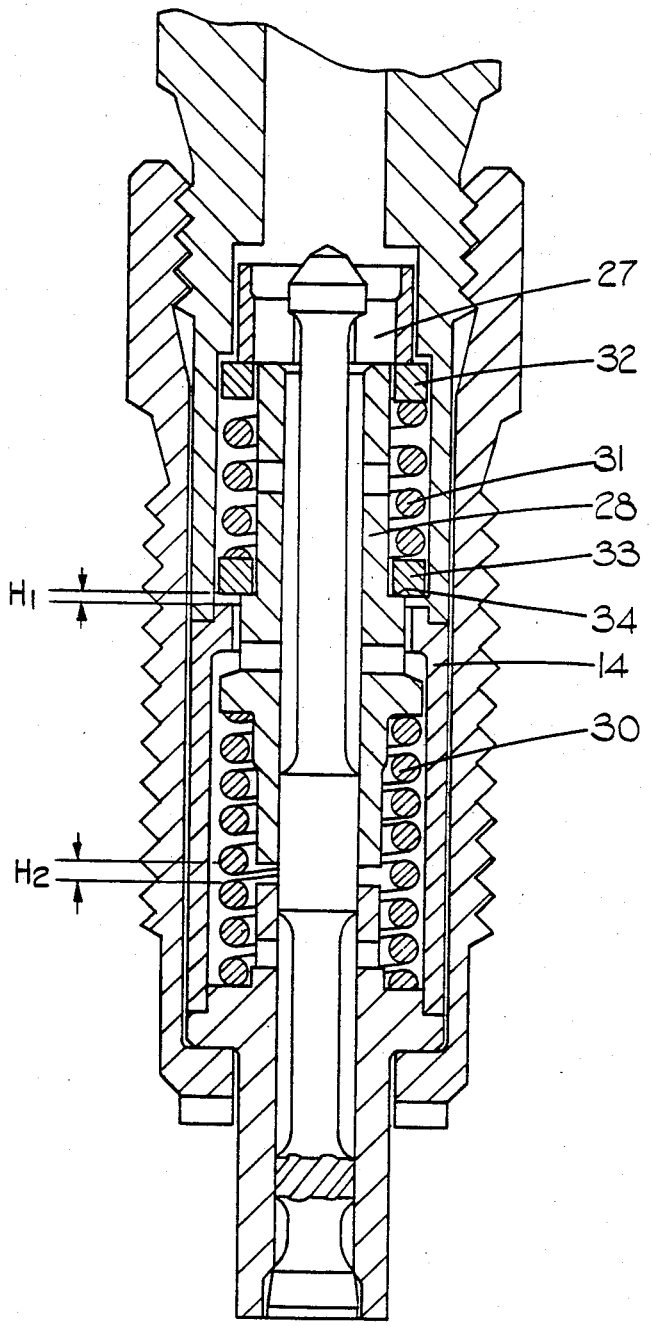
FIG. 3 shows a cross sectional view of the fuel injection nozzle in its third embodiment.

In the construction shown in FIG. 3 the abutment 32 is in engagement with the retainer member 27 and the abutment 33 in engagement with the step 34 on the sleeve member 28. The spring 31 is weaker than the spring 30 and the spring 30 alone biases the valve member to the closed position. As the fuel pressure in the chamber increases the valve member will move against the action of the spring 30 until the abutment 33 engages the end of the tubular member 14, thereafter the valve member moving against the action of both springs.

I claim:

1. A fuel injection nozzle for supplying fuel to an internal combustion engine, the nozzle being of the so-called outwardly opening type and comprising a valve assembly housed within a chamber, a fuel inlet to said chamber, the valve assembly including a valve body defining a bore, a seating defined adjacent one end of the bore, the portion of the bore downstream of the seating defining an outlet opening, a valve member slidable in said bore, the valve member having a head located in said outlet opening and being shaped to cooperate with said seating, a retaining member mounted on the stem of the valve member remote from the seating, a sleeve member mounted about the portion of the stem which extends from the bore, said sleeve member engaging said retaining member, a flange on the sleeve member, a first coiled compression spring acting between said flange and a surface on said body, said first spring acting to bias the head of the valve member into contact with the seating, a pair of annular spring abutments located about said sleeve member intermediate said retaining member and the flange, a second coiled compression spring positioned between the abutments, means defining a step in said chamber to limit the movement of the one spring abutment which is nearer to the valve head, the other spring abutment initially engaging a further step in the chamber, but being engaged by said retaining member during movement of the valve member, said one spring abutment initially engaging a step defined in the sleeve member the axial distance in the closed position of the valve member, between the first mentioned step in the chamber and the one spring abutment being less than the axial distance between the other spring abutment and the retaining member whereby initially the second spring opposes the action of the first spring until the one abutment engages the first mentioned step whereafter the first spring alone acts on the valve member until the other spring abutment is engaged by the retaining member.

2. A nozzle according to claim 1 in which said sleeve member is engageable with said body to limit the maximum movement of the valve member.

* * * * *